US005568351A

United States Patent [19]

West et al.

[11] Patent Number: 5,568,351

[45] Date of Patent: Oct. 22, 1996

[54] ADJUSTABLE ANTISTATIC BRACELET WITH SNAP-ASSEMBLED PERMANENT CAP

[75] Inventors: Robert J. West, Alta Loma; Mark E. Hempel, Chino Hills, both of Calif.

[73] Assignee: Desco Industries, Inc., Walnut, Calif.

[21] Appl. No.: 486,002

[22] Filed: Jun. 8, 1995

[51] Int. Cl.[6] ..... H05F 3/02

[52] U.S. Cl. ..... 361/220; 361/212

[58] Field of Search ..... 361/212, 220, 361/223, 224; 439/37, 669, 906, 86, 92

[56] References Cited

U.S. PATENT DOCUMENTS 4,745,519 5/1988 Breidegam ..... 361/220
4,755,144 7/1988 Gordon et al. ..... 361/220
5,018,044 5/1991 Weiss ..... 361/220
5,036,423 7/1991 Williams ..... 361/212
5,134,538 7/1992 Weiss ..... 361/220

*Primary Examiner*—Fritz M. Fleming
*Attorney, Agent, or Firm*—Richard L. Gausewitz

[57] ABSTRACT

An antistatic metal-link bracelet in which the connector portion has no moving parts. An insulating cap snap-connects permanently to a metal channel. The snap connection is such as to facilitate manufacture at low cost, and to make a permanent low-resistance electrical connection through which static electricity may drain to a grounding cord.

11 Claims, 2 Drawing Sheets

ADJUSTABLE ANTISTATIC BRACELET WITH SNAP-ASSEMBLED PERMANENT CAP

BACKGROUND OF THE INVENTION

In U.S. Pat. No. 5,036,423, there is shown and described an adjustable antistatic bracelet having a snap-on cap (cover) and that also snaps off upon application of moderate manual force. A problem with actual operation of the bracelet of U.S. Pat. No. 5,036,423 is that the cap may snap off accidentally, thus creating a distinct nuisance for the wearer. The snapping-off may also result in loss of the cap. Such snapping-off of the cap may occur as the result of wear, or (for example) in response to pulling of the electrical grounding cord that is connected to the cap.

It is also emphasized that repeated snapping-on and snapping off can somewhat degrade electrical contacts, or can make possible the entrance of insulating films into contact regions. The contacts and contact regions here referred to are not on the stud but are instead internal.

It would be a distinct improvement to have an antistatic bracelet, the cap of which easily snaps on during assembly of the bracelet at the factory, yet cannot thereafter wear at all or come off at all. There could, for example, be almost any amount of pulling on the grounding cord without danger that the cap will come off.

It would be a still further improvement to have an antistatic bracelet, with permanent cap, that can be mass-manufactured at little or no cost differential compared to a similar bracelet with a snap-on, snap-off cap.

Another object is to provide a bracelet connector assembly that will not scratch coating material off the metal links.

SUMMARY OF THE INVENTION

The present invention provides a precision antistatic bracelet wherein the injection-molded, synthetic resin cap (cover) body does not directly snap-connect to the backplate (channel). Instead a clip is permanently associated with such synthetic resin cap body and provides a double function. One function is to conduct static electricity from the backplate to the electrical-connector stud and thus to ground. The other function is to easily snap-connect to the backplate in a permanent manner preventing wear and preventing cap removal.

The clip is preassembled with the synthetic resin cap body by means of the stud assembly, and in a nesting manner that facilitates preassembly and prevents the clip from turning relative to the cap body prior to final assembly with the backplate.

The free edges of the channel-shaped backplate are constructed to perform a link-retaining function while preventing scratching of the bracelet links.

DETAILED DESCRIPTION OF THE PREFERRED EMBODIMENT

The above-specified U.S. Pat. No. 5,036,423 is hereby incorporated by reference herein.

The adjustable antistatic bracelet of the invention comprises a connector element (member) 10, an expandable (expansible) and contractible, resilient, metal-link wristband 11, and a cap or cover 12. It also comprises dual-purpose electrical connection means described in detail subsequently.

Figure 1:
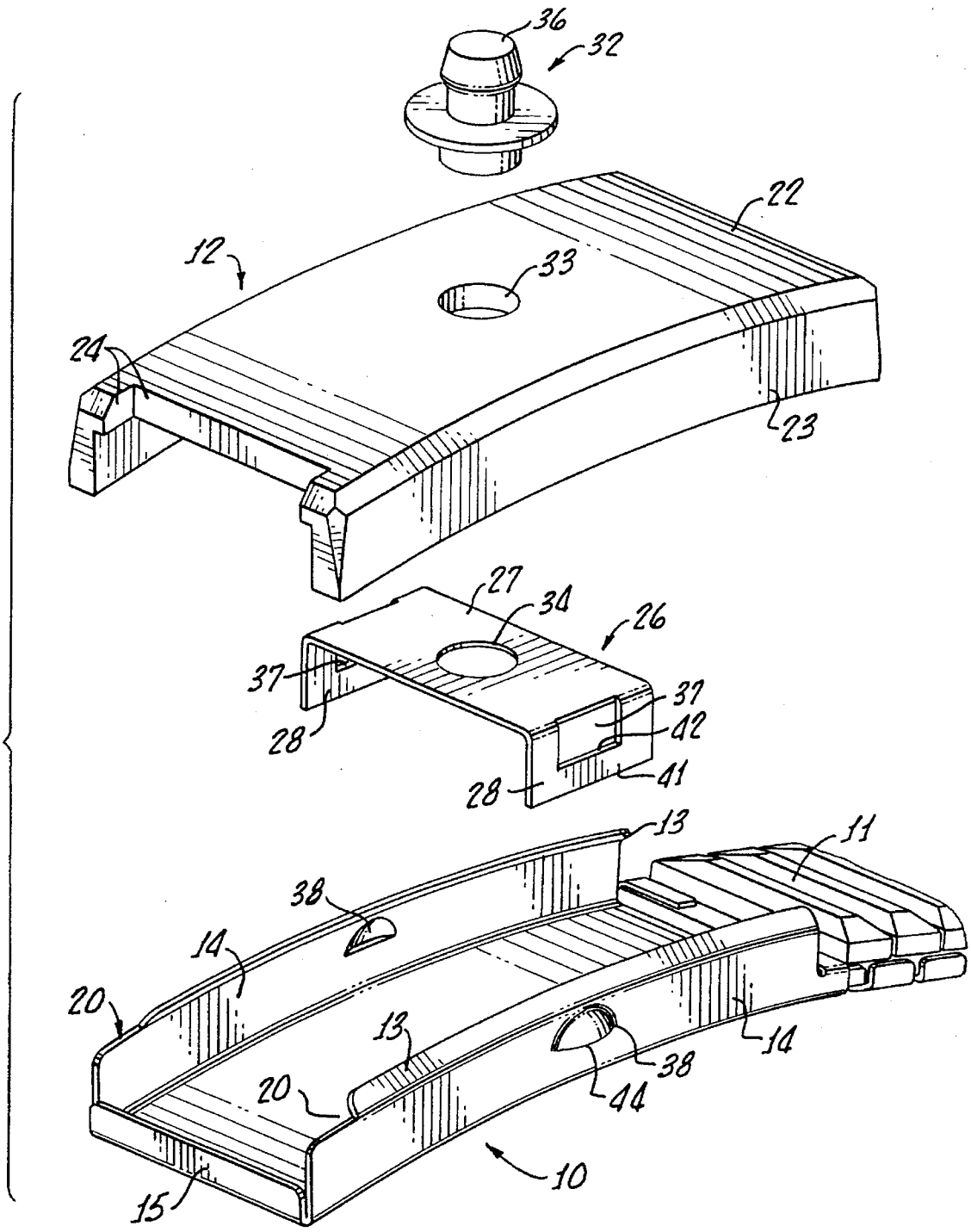
FIG. 1 is an exploded isometric view of the connector portion of the present antistatic bracelet.
Figure 4:
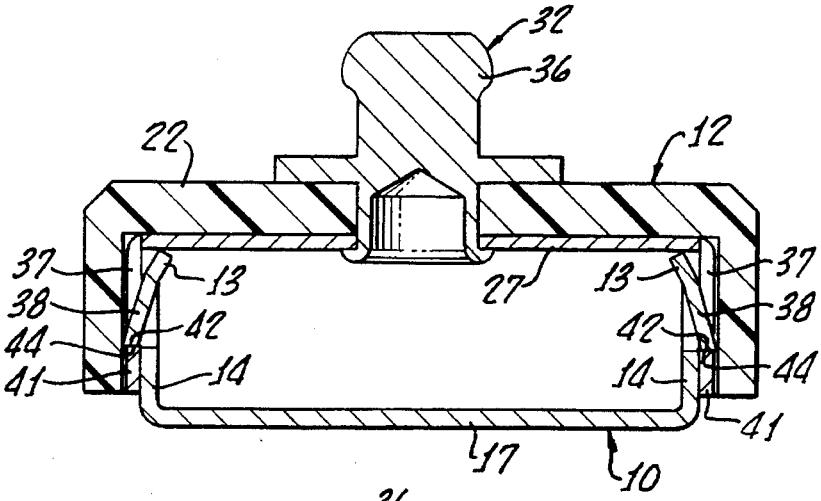
FIG. 4 is a transverse sectional view on line 4—4 of FIG. 3.

Connector element 10 is a stainless steel backplate, being a channel sized to receive end portions of wristband 11. As best shown in FIGS. 1 and 4, the channel has inwardly-inclined edge flanges 13 at the upper edges of the side flanges 14. There are connector flanges (web flanges) 15, 16 at the channel ends.

The channel 10 also has a web 17 that is in contact with the wrist of the wearer, so as to conduct static electricity from his or her wrist.

The edge flanges 13 are small, and (as above indicated) are not parallel to web 17. Instead, they are inclined at an acute angle to the vertical (when web 17 is substantially horizontal). The incline and the sizes of flanges 13 are such as to trap bracelet 11. However, the extreme edges of flanges 13 are so inclined and located as not to engage bracelet 11. Thus, any burrs on such extreme edges will not rub insulating coating material off the top of the bracelet.

At opposite ends of web 17 are the connector flanges 15 and 16, these being upwardly bent. Each such flange 15, 16 extends upwardly into a gap between adjacent links in the lower layer of the double-layer "Speidel"(trademark) wristband 11. In the case of connector flange 16, the connection is permanent because tangs (not shown) on the channel are bent into positions preventing removal of the associated end of the wristband.

In the case of connector flange 15, there is no permanent connection (no tangs), since this is the end of the backplate at which size adjustment occurs. At regions near connector flange 15, the upper portions of side flanges 14 are cut away (reference being made to FIG. 1) so that there are no inwardly-bent edge flanges 13 in such regions. This is one of the factors permitting insertion and adjustment of an end portion of wristband 11 even though cap 12 remains permanently in place. Such regions where the flanges are cut away are numbered 20 in FIG. 1.

Proceeding next to a description of the cap or cover 12, which is formed of synthetic resin and is electrically insulating, it is shaped as a channel and has a top or web portion 22 and side flanges 23. The size relationships are such that when top 22 is mounted over the backplate 10, side flanges 23 nest closely adjacent and outside side flanges 14 of the backplate. One end of top 22 is cut back or recessed back, at 24, being the same end of the backplate as that where the cut-away regions 20 are located. The sizes of the regions 24 and 20 of the cap and backplate, respectively, are calculated to permit insertion and removal of the adjustable end of wristband 11 even though the cover is permanently in position on the backplate.

DESCRIPTION OF THE MEANS FOR MAKING PERMANENT mECHANICAL AND ELECTRICAL CONNECTIONS BETWEEN CAP 12 AND BACKPLATE 10

A C-clip 26 is provided, having a cross-member 27 and two opposed flanges (arms) 28. Clip 26 is formed of a metal, such as a stainless steel, which metal does not have more than a small amount of springiness. Thus, the flanges 28 may be readily bent at right angles to cross-member 27, without need for a subsequent operation to enhance springiness.

Figure 2:
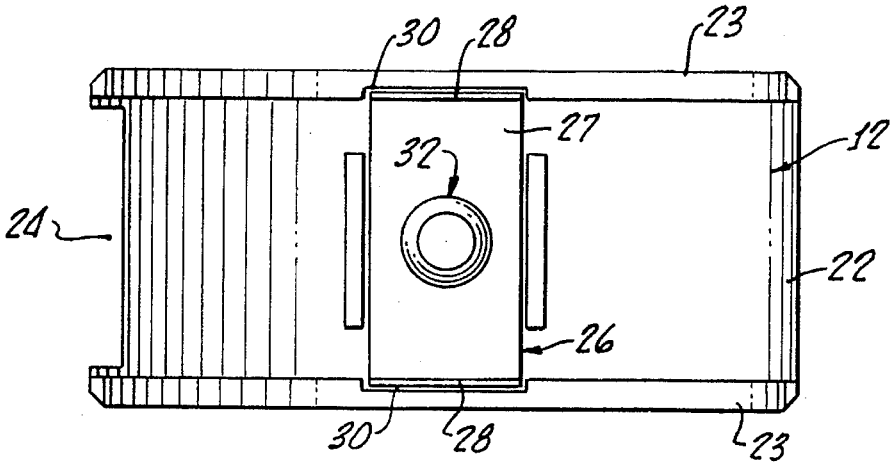
FIG. 2 is a bottom plan view of the backplate-clip combination.

Interior recesses 30 (FIG. 2) are formed centrally in the opposed side flanges 23 of cap 12, during the molding of the cap. Each recess is shaped to receive one of the flanges 28, despite the presence of the side flanges 14 of the backplate in closely adjacent relationship with side flanges 23 of the cap.

In assembling C-clip 27 with cap 12, the C-clip is nested into the underside of the cap in such position that flanges 28 fit into recesses 30. Then, a flanged rivet 32 is extended through a central hole 33 that is formed in the center of cap web 22, and also through a central hole 34 that is formed in the center of cross-member 27 of the C-clip. The rivet is then expanded to complete a mechanical connection between cap 12 and the C-clip.

The upper end of the rivet 32 is shaped as a stud 36 adapted to make snap connection with a connector at the end of a grounding cord for the antistatic bracelet.

Means are provided to make a simple, secure snap-connection between the flanges 28 of C-clip 26 and the side flanges 14 of backplate 10, when the combined cap 12 and C-clip 26 are mounted over the backplate. Such means comprise openings 37 in flanges 28 of the C-clip, and further comprise combination cam and locking protuberances 38 formed at the centers of side flanges 14 of the backplate.

In the preferred form, each opening 37 (as shown in FIG. 1) has a horizontal flange portion 41 therebeneath, and which has a horizontal upper edge 42. The cam and locking protuberances 38 each have (as shown in FIG. 1) a downwardly and outwardly inclined and rounded cam surface and a horizontal bottom edge 44. The cam surfaces are hood-like. As best shown in FIG. 4, each horizontal bottom edge 44 is displaced outwardly from the remainder of the associated flange 28 by a distance approximately equal to the thickness of the material forming the backplate.

The size relationships are caused to be such that when the lower surface of cross-member 27 is seated on the inwardly-bent edge regions (or flanges) 13 of backplate 10, each horizontal upper edge 42 (FIG. 1) is at elevation just barely below horizontal bottom edge 44 of the associated cam and locking protuberance 38.

There is sufficient spring in the C-clip 26 to permit the lower portions of flanges 28 thereof, that is to say the horizontal flange portions 41 thereof, to be cammed outwardly, without going beyond their elastic limits, by the cam regions of the cam and locking protuberances 38. Accordingly, when the underside of cross-member 27 seats on edge regions 13 of the backplate, horizontal flange portions 41 snap inwardly and come near side flanges 14 of the backplate. The horizontal upper edges 42 are then directly beneath horizontal bottom edges 44 of elements 38, so that the C-clip—and thus the combination C-clip and cap 12—cannot be removed by any reasonable pulling on the stud.

As shown in FIG. 4, side flanges 23 of cap 12, at the recessed regions thereof, are near flanges or arms 28 of the C-clip to thus form sandwiched relationships. Any chances that the lower portions 41 of the flanges 28 may move (or be unintentionally moved) outwardly from beneath bottom edges 44 are minimal.

SUMMARY OF MANUFACTURE AND OPERATION cap 12, backplate 10, and C-clip 26 are separately manufactured. Then, C-clip 26 is nested into cap 12 in nonrotatable relationship in recesses 30, following which rivet 32 is inserted and expanded to form the permanent connection between cap and C-clip. Then, the combination cap and C-clip are nested downwardly over backplate 10 to create the snap action and locking action between elements 38 and 41, as described in the preceding paragraphs. The latter assembly operation is achieved in a few seconds and is done when the cap is so oriented that the cutback regions 20 and 24 (FIG. 1) are at the same end of the device.

Prior to the assembly of the combination cap and C-clip with the backplate, one end of a pre-cut length of expandable metal wristband 11 is inserted into the end of the backplate not having the cutback regions. The tangs (not shown) are bent to permanently hold such end in locked relationship with connector flange 16.

Figure 3:
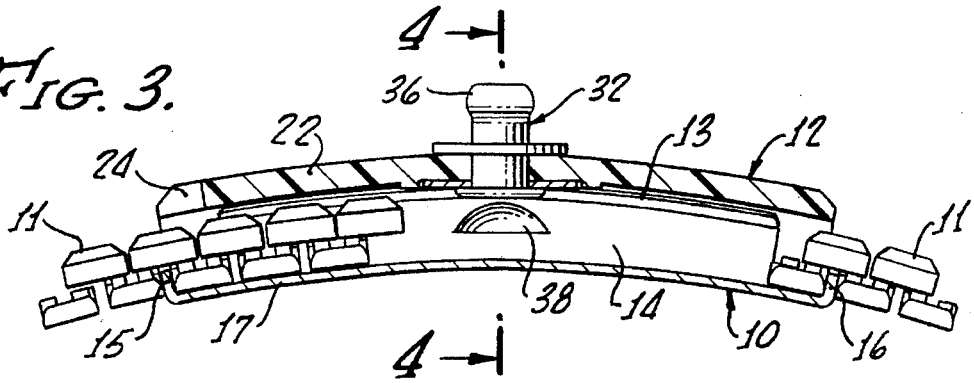
FIG. 3 is a longitudinal vertical sectional view of the connector portion of the bracelet.
Figure 5:
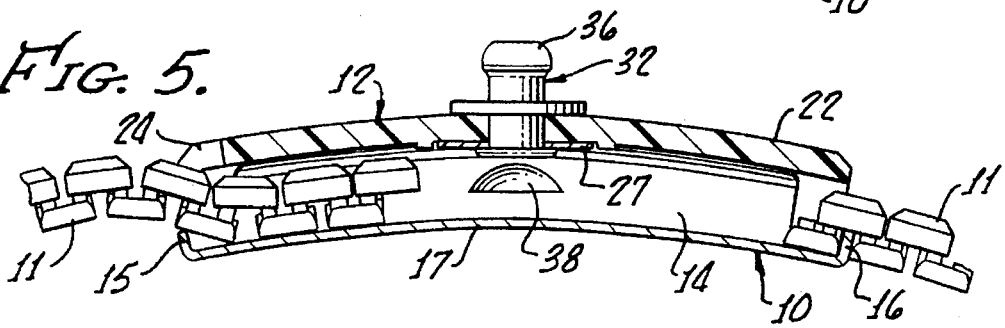
FIG. 5 corresponds to FIG. 3 but shows the bracelet being adjusted in size.

To achieve an antistatic metal bracelet of desired diameter, the other end of the wristband 11 is inclined (FIG. 5) into the end of the combination cap and backplate having the cutaway portions 20, 24 (FIG. 1) and is then bent downwardly (FIG. 3) so that the flange 15 on the backplate locks into the desired groove between two adjacent lower links of the wristband 11.

The cap will not separate from the backplate despite long usage, absent severe mistreatment, and the insulating-coated upper layer of links in the wristband will not be deprived of any insulation despite repeated usage. The latter is because the upwardly-inclined edges 13 cannot engage the wristband where any burrs or rough portions could abrade the insulating coating.

It is a feature that there is an effective long-lasting low-resistance electrical path for flow of static electricity from flange 17 to stud 36 and thus to ground. This path is from web 17 to side flanges 14 and to edge flanges 13, through various paths to flange 28 and cross-member 27, and thence to and through rivet element 32.

The foregoing detailed description is to be clearly understood as given by way of illustration and example only, the spirit and scope of this invention being limited solely by the appended claims.

What is claimed is:

1. A metal-link expandable antistatic bracelet having no removable parts, which comprises:

(a) a metal backplate shaped generally as a channel,
 said backplate having a web adapted to contact the wrist of the wearer,
 said backplate having side flanges extending upwardly from said web, (b) an electrically insulating cap shaped generally as a channel,
 said cap having a web shaped and sized to fit over said backplate,
 said cap having side flanges adapted to nest over said backplate flanges, (c) an expandable and contractible metal-link wristband, (d) means to connect one end portion of said wristband to one end of said backplate, (e) means to adjustably connect the other end portion of said wristband to the other end of said backplate, in such manner that the diameter of said wristband may be varied, (f) electrical connector means on the upper side of said cap web to make electrical connection to an electrical grounding cord, and (g) means on said cap to make both a snap-action permanent nonremovable mechanical connection between said cap and said backplate when said cap is mounted over said backplate, and to make permanent, nonremovable electrical connection between said electrical connector means and said backplate when said cap is mounted over said backplate.

2. The invention as claimed in claim 1, in which said means on said cap to make a snap-action permanent mechanical connection, and permanent electrical connection, comprises a metal C-clip mounted over said backplate with its flanges nested relative to said side flanges of said backplate, and further comprises snap-action elements to make permanent connection between said flanges of said C-clip and said side flanges of said backplate, and further comprises a permanent mechanical and electrical connection between said C-clip and said electrical connector means on said cap.

3. The invention as claimed in claim 2, in which said snap-action elements comprise cam and locking protuberances on said side flanges of said backplate, and portions of said C-clip flanges, said protuberances and said portions being shaped to effect, in response to nesting of said cap over said backplate, permanent locking of said C-clip to said backplate and thus of said cap to said backplate.

4. The invention as claimed in claim 2, in which said flanges of said C-clip are nested on the outside of said side flanges of said backplate, and in which said side flanges of said cap are nested on the outside of said flanges of said C-clip, whereby said flanges of said C-clip are sandwiched between said cap side flanges and said backplate side flanges.

5. The invention as claimed in claim 4, in which said cap is molded of synthetic resin, and has recesses in the interior regions of said flanges of said cap, said recesses receiving said flanges of said C-clip.

6. The invention as claimed in claim 1, in which inwardly-bent edge flanges are provided on said side flanges of said backplate, at the edges thereof remote from said backplate web, said backplate being adapted to receive therein, below said edge flanges, said other end portion of said wristband, said edge flanges being positioned to maintain said other end portion in said channel.

7. The invention as claimed in claim 6, in which said means to adjustably connect said other end portion of said wristband to said other end of said backplate comprises a transverse web flange extending upwardly from said web of said backplate and adapted to fit between adjacent links of said wristband, said edge flanges being cut back in the vicinity of said web flange, said cap web also being cut back in the vicinity of said web flange, the amounts of said cutbacks being sufficiently large that said other end of said wristband may be inserted below said edge flanges and below said cap web, into said backplate, despite the permanent positioning of said cap on said backplate, the amounts of said cutbacks being sufficiently small that said other end portion of said wristband may have said web flange inserted between adjacent links thereof, and said web flange will remain so inserted to prevent detachment of said wristband from said backplate.

8. The invention as claimed in claim 7, in which said edge flanges are not parallel to said backplate web but instead inclined upwardly and inwardly, for prevention of contact between the extreme edges of said web flanges and said other end portion of said wristband.

9. The invention as claimed in claim 6, in which said edge flanges are not parallel to said backplate web but instead inclined upwardly and inwardly, for prevention of contact between the extreme edges of said web flanges and said other end portion of said wristband.

10. The invention as claimed in claim 1, in which said means to adjustably connect said other end portion of said wristband to said other end of said backplate comprises a transverse web flange extending upwardly from said web of said backplate and adapted to fit between adjacent links of said wristband, said cap web being cut back in the vicinity of said web flange, the amount of said cutback being sufficiently large that said other end of said wristband may be inserted below said edge flanges and below said cap web, into said backplate, despite the permanent positioning of said cap on said backplate, the amount of said cutback being sufficiently small that said other end portion of said wristband may have said web flange inserted between adjacent links thereof, and said web flange will remain so inserted to prevent detachment of said wristband from said backplate.

11. An antistatic bracelet which comprises:

(a) a metal backplate shaped generally as a channel,
- said backplate having a web adapted to contact a wrist of the wearer,
- said backplate having side flanges extending upwardly from said web,
- said backplate having edge flanges provided on said side flanges of said backplate, at the edges thereof, remote from said backplate web,
  - said edge flanges not being parallel to said backplate web, but instead being inclined upwardly and inwardly,
- said backplate being adapted to receive therein, below said edge flanges, the end portion of a metal-link wristband,
  - said edge flanges being positioned to maintain said end portion in said backplate,
  - said edge flanges having their extreme edges out of contact with said end portion of said wristband, for prevention of scraping of the top of said end portion of said wristband, (b) an electrically insulating cap also shaped generally as a channel,
- said cap having a web shaped and sized to fit over said backplate,
- said cap having side flanges adapted to nest on the outer sides of said backplate flanges, (c) an expandable and contractible metal-link wristband, (d) upwardly-extending flange means on said backplate web to connect the other end portion of said wristband to one end of said backplate, (e) a second flange on said backplate web to adjustably connect said first-mentioned end portion of said wristband to said other end of said backplate, in such manner that the diameter of said wristband may be varied, (f) a metal stud provided on the upper side of said cap web to make electrical connection to an electrical grounding cord, and (g) means on said cap to make a snap-action connection between said cap and said backplate when said cap is nested over said backplate, and to make electrical connection between said backplate and said stud.

* * * * *